US005161554A

United States Patent [19]

Fitjer

[11] Patent Number: 5,161,554

[45] Date of Patent: Nov. 10, 1992

[54] BRUSH, IN PARTICULAR MASCARA BRUSH

[75] Inventor: Holger Fitjer, Ansbach, Fed. Rep. of Germany

[73] Assignee: Georg Karl Geka-Brush GmbH, Bechhofen-Waizendorf, Fed. Rep. of Germany

[21] Appl. No.: 731,235

[22] Filed: Jul. 17, 1991

[30] Foreign Application Priority Data

Jul. 18, 1990 [DE] Fed. Rep. of Germany ..... 4022890

[51] Int. Cl.[5] ..... A45D 40/26

[52] U.S. Cl. ..... 132/218; 132/320; 15/159.1; 15/207.2

[58] Field of Search ..... 132/216, 218, 313, 317, 132/320; 401/126, 129; 15/159 A, 159 R, 206

[56] References Cited

U.S. PATENT DOCUMENTS

| | | | |
|---|---|---|---|
| 2,465,396 | 3/1949 | Peterson et al. | 15/206 |
| 2,972,157 | 2/1961 | Peterson | 15/206 |
| 3,090,061 | 5/1963 | Charvat | 15/159 R |
| 3,186,018 | 6/1965 | Shaw | 15/159 R |
| 3,217,074 | 11/1965 | Gould et al. | 15/159 A |
| 3,567,569 | 3/1971 | Ono et al. | 15/159 A |
| 3,582,140 | 6/1971 | Kaufman et al. | 15/206 |
| 4,381,325 | 4/1983 | Masuda et al. | 15/159 A |
| 4,733,425 | 3/1988 | Hartel et al. | 15/206 |
| 4,887,622 | 12/1989 | Gueret | 132/320 |
| 4,927,281 | 5/1990 | Gueret | 15/206 |

FOREIGN PATENT DOCUMENTS

| | | | |
|---|---|---|---|
| 2085718 | 5/1982 | United Kingdom | 15/206 |

*Primary Examiner*—Gene Mancene
*Assistant Examiner*—Frank A. LaViola
*Attorney, Agent, or Firm*—Browdy and Neimark

[57] ABSTRACT

In a brush, in particular a mascara brush, in which a plurality of bristles is secured between twisted segments of wire and extends on all sides from these twisted wire segments, it is provided for attaining a uniform distribution of tips while avoiding capillary effects at the bristles, that the bristles (4) are embodied as segments of fibers of round cross section, the diameter (D1 or D2) of which is alternatingly larger and smaller, viewed longitudinally.

14 Claims, 2 Drawing Sheets

FIG. 1
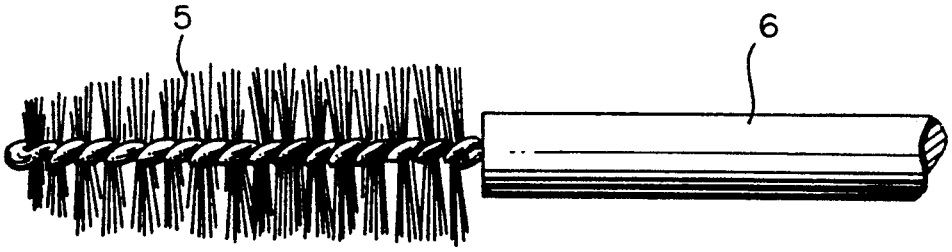
FIG. 2
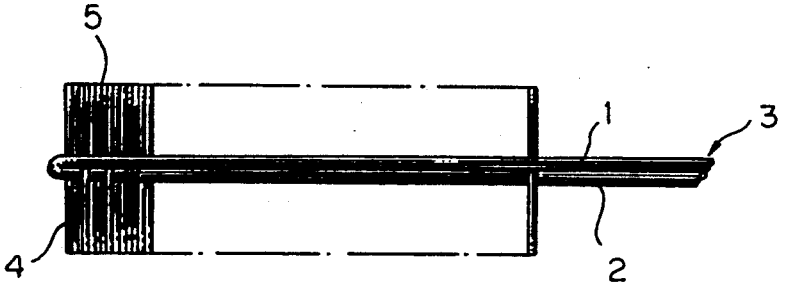
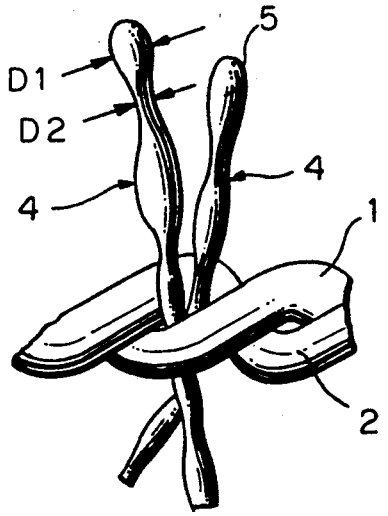
FIG. 3
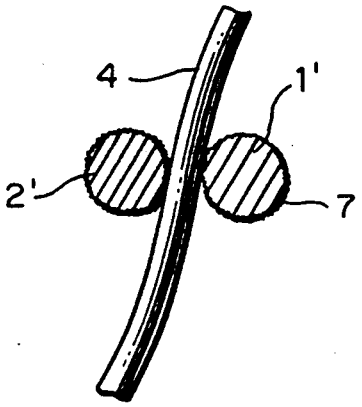
FIG. 4

BRUSH, IN PARTICULAR MASCARA BRUSH

The invention relates to a brush, in particular a mascara brush, wherein a plurality of bristles is fixed in place between twisted segments of wire and extends to all sides away from these twisted segments of wire.

Such brushes, in particular mascara brushes, have been known for many years. Earlier brushes were originally equipped with natural bristles, such as goat bristles. Such bristles gave a random distribution of the tips because of their non-round cross section and tubular structure. Later, brushes having synthetic fibers having a round, solid cross section were used. The round cross section of the synthetic fibers resulted in the fibers following the helical configuration of the twisted wires which also form the distribution of the bristle tips.

Brushes made with synthetic fibers were initially welcomed for mascara brushes. However, in the course of further development, attempts were made, particularly for mascara products having a certain composition and consistency, to reproduce the random distribution of bristle tips over the jacket face of the brush that was produced earlier with natural hairs.

To this end, European Patent Application EP-A-0 250 680 provides the use of synthetic fibers with a non-round, such as an X-shaped cross section, or a tubular hollow cross section, so as to reproduce the non-round configuration of animal hairs, provided earlier by goat hairs.

For some applications, however, bristles of hollow fibers or with an X-shaped cross section are unsuitable. For example, although these fibers do pick up mascara fluid by a certain capillary action, they sometimes tend not to dispense the mascara again in satisfactory manner, depending on the viscosity of some mascara.

With this as the point of departure, it is the object of the invention to provide a brush, in particular a mascara brush, that has advantageous application properties and the most random possible distribution of bristle tips. This novel brush is produced without doing so at the cost of capillary action, should that appear undesirable. The object of the invention is achieved by producing fibers of round cross section, the diameter of which is alternatingly greater and smaller viewed in the longitudinal direction.

These novel fibers are produced by extrusion when pulled out with varying removal forces, so that correspondingly a diameter that varies periodically in accordance with the varying removal forces is created.

The use of such fibers leads to very full and voluminous brushes having a random distribution of bristle tips, which is dictated by the fact that the twisted wires randomly engage regions of larger diameter and regions of smaller diameter of the bristles. The random geometrical engagement of the wires with the bristles is reflected in a corresponding random distribution of the tips of the bristles.

A similar random distributed engagement ratio with respect to the securing of the bristles is attained when the engaging wires have a non-round cross section. For example, a random distribution of bristle ties may be provided when the wire segments are rectangular, for instance square, in cross section.

Wires with such cross sections are commercially available in the quality required for producing brushes and accordingly make economical production possible. When drawn fibers with varying diameters are used with such wires, the effect sought with such fibers is further reinforced. However, when such wires are used, a more or less random distribution of the tips can still be attained with conventional fibers having a uniform thickness longitudinally.

A further modification of the basic concept of the invention of attaining a random distribution of the interaction in force between the bristles and the wire segments comprises the use of wire segments having a textured surface. With this kind of surface texturing, any individual bristle secured between the wire segments encounters various oriented retention forces, which in turns leads to the most random possible distribution of the bristle tips.

It may also be an objective of the invention that the wire segments be provided with a relatively soft plastic coating. The defined geometric relationships obtained between uniformly round fibers on the one hand and uniformly round wire cross sections on the other, which otherwise would lead to the development of a helical configuration, are avoided with the use of a soft plastic coating on the wire. Instead, the soft plastic coating leads to a variation in appearance of the bristle tips, in the sense of a more random distribution of such tips.

The use of plastic-coated wire segments is known per se from toothbrushes, where the plastic coating is used to avoid painful electrical shocks between the wire and amalgam fillings in tooth-cleaning. Cleaning brushes, for instance for furniture, with such plastic-coated wire segments are also well known. The plastic is intended essentially to prevent damage to the furniture to be cleaned by the bare surface of the wire.

Particularly in mascara brushes, the plastic coating will not only have an influence on the distribution of bristle tips, but can also be advantageous through selecting a plastic coating which has surface properties that repel the mascara vehicle fluid. When such a plastic is selected, the mascara fluid does not sit firmly on the surface of the wires between adjacent bristles, as can often be observed in known mascara brushes, which leads to clumping which can in turn be deposited on the eyelashes.

When mascara brushes of this kind are used for water-based mascara fluids, a plastic is accordingly preferably used which either has intrinsic hydrophobic surface properties, or the surface of which is suitably treated subsequently in order to achieve such properties.

The plastic-coated wire segments can favorably be produced by applying the plastic coating to the wire by extrusion. When extrusion is used to produce the plastic coated wire, it is also possible to embody the surface of the plastic coating as textured by the use of suitable extrusion nozzles, and in this way to still further reinforce the aforementioned "random" engagement properties.

In all the above-described embodiments, it is possible, after the twisting of the wires, to cut the bristles, producing an asymmetrical brush cross section, so that depending on the desired application properties, the side having the shorter and correspondingly more rigid bristles, for instance, or the side with longer and correspondingly softer bristles, can be used.

In another embodiment, the bristles are made of two plastic components, with the inner component forming a kind of soft core and being surrounded in jacket-like fashion by a harder plastic. With this kind of configuration, the structure of natural hair is simulated, and correspondingly a comparable action to that of natural hair is attained.

Bristles also can be made as hollow fibers which are divided by a plurality of inner ribs. For instance the inner ribs may be disposed approximately in an X-shape, so that the hollow space of the hollow fibers is subdivided into four capillaries of very small cross section. This avoids an undesirable capillary action with larger cross sections.

Another embodiment provides that the bristles are embodied as S-shaped in cross section, with the curves of the S extending virtually circularly and forming the longitudinal conduits. Another embodiment provides that the fibers used are intrinsically corrugated or wavy, or that they have a zig-zag course, which can for instance be attained by treatment with a toothed wheel combination after extrusion, or that they are merely curved, which likewise leads to a random, nonuniform distribution of bristle tips.

Finally, it may also be provided that the wire segments used are embodied as lengths of wire tubing hollow on the inside, so that upon twisting thereof, securing conditions that vary from place to place are created.

The invention will now be described in detail in terms of preferred exemplary embodiments, in conjunction with the drawing. Shown are:

FIG. 1, a perspective view of a brush according to the invention, which is embodied as a mascara brush;

FIG. 2, a view of the wire segment with the inlaid bristles prior to the twisting;

FIG. 3, a schematic, perspective view of a segment of the twisted wires, with bristles of variable diameter secured between them;

FIG. 4, a section through wire segments of round external cross section and with a rough surface;

FIG. 5, a section through wire segments of rectangular cross section; and

FIG. 6, an embodiment in which wire segments of round cross section are provided with a plastic jacket.

FIG. 7, a section through a bristle made from two plastic components.

FIG. 8, a section through a bristle having a plurality of hollow conduits.

FIG. 9, a section through a bristle having a plurality of hollow conduits formed by S curves.

FIG. 10, a view of a portion of a bristle having a zig zag configuration along its longitudinal axis.

A mascara brush shown in the drawing includes two wire segments 1, 2, which are created by bending one continuous length 3 of wire. A plurality of bristles 4 is placed in a manner known per se between these wire segments 1, 2, and by twisting the wire segments it is attained that the tips 5 of the bristles 4 protrude from between the wire segments (1, 2) 360° around the twisted wire segments 1, 2, as shown in FIG. 1 over the length of the wire segments. It can also be seen in FIG. 1 that the wire segments 1, 2 are fixed at the ends in a handle 6.

To attain the random distribution of the tips 5 that can be seen in FIG. 1, there are various possibilities, shown in conjunction with FIGS. 3–6, which share the basic concept that the attempt is to create varying engagement conditions of the wire segments 1, 2 from one bristle to another, so that the helical structure produced by twisting of the wire segments 1, 2 is reduced or eliminated and is no longer reflected in the distribution of the tips 5.

In the exemplary embodiment shown in FIG. 3, the wire segments 1, 2 are embodied from a round wire 3. The bristles 4 are formed by segments of fibers that have different diameters as for example but not limited to D1 and D2 viewed in the longitudinal direction, although the cross-sectional configuration in each figure of the drawings is round over the entire length.

As shown on a larger and exaggerated scale in FIG. 3, bristle segments having the maximum diameter D1 on the one hand and on the other, bristle segments with the minimum diameter D2 and diameters located continuously between these, come to rest randomly between the wire segments 1, 2, so that for each bristle 4, different retention conditions are created, and correspondingly the individual bristles protrude away from the wire segments 1, 2, at variable angles with respect to the longitudinal axes of the wire segments at the retention point. The result is a wide and random distribution of the tips 5 shown in FIG. 1.

In an alternative embodiment, as shown in FIG. 4, the round wire segments 1', 2' have a rough surface 7, so that as a result of this as well, there are no defined angular conditions at the securing point of the bristle 4, and a wide and random distribution of tips is attained.

In the embodiment of FIG. 5, the wire 3 and correspondingly the wire segments 1'', 2'' have a square cross section. The tips of the bristles 4 extend radially outward depending on where the edges 8 in each individual case engage the bristle.

In the embodiment of FIG. 6, the wire segments 1''', 2''' are surrounded with a plastic jacket 9 of soft plastic, which is compressed in the engagement region at the bristles 4. When a mascara brush is used for water-based mascara products, the plastic jacket 9 or the surface of the plastic jacket 10 is adjusted such that the surface is water-repellent, thus preventing the mascara product from sticking to the surface of the wires.

FIGS. 7, 8, 9 and 10, show different embodiments of bristle or fiber 4.

FIG. 7 shows a cross section through a bristle 4 made of two plastic components, the inner core of plastic 11 being softer than the outer facing 10.

Figure 5:
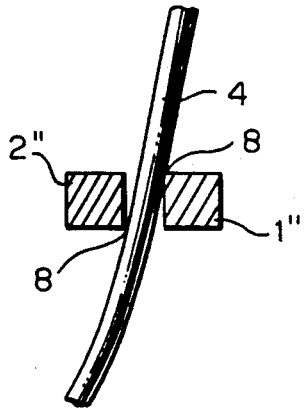
Figure 6:
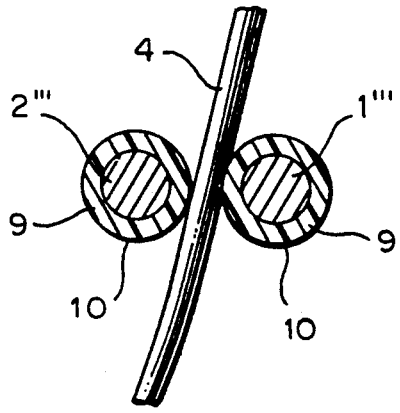
Figure 7:
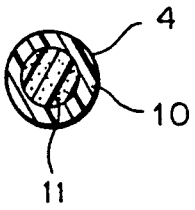
Figure 8:
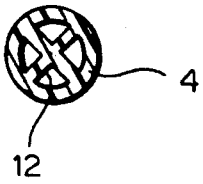
FIG. 8 shows a cross section through a bristle 4 having a plurality of hollow conduits formed by 'X' shaped ribs 12.
Figure 9:
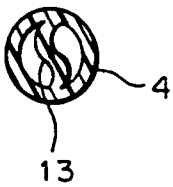
FIG. 9 shows a cross section through a bristle 4 having a plurality of hollow conduits formed by 'S' shaped rib 13.
Figure 10:
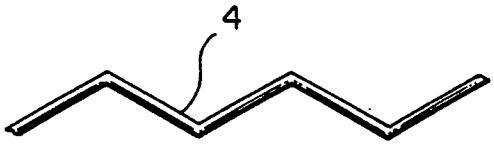
FIG. 10 shows a bristle 4 having a zig zag configuration along its longitudinal axis.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A brush, in particular a mascara brush, said brush comprising, a plurality of bristles secured between twisted segments of wire, said plurality of bristles extending on all sides away from these twisted wire segments, said bristles (4) are embodied as segments of fibers of round cross section, the diameter (D1 or D2) of which is alternatingly larger and smaller, viewed longitudinally.

2. The brush of claim 1, said fibers are embodied as fibers drawn upon extrusion with varying removal forces.

3. The brush of claim 1, wherein said wire segments (1''', 2''') are provided with a relatively soft plastic coating (9).

4. The brush of claim 3, wherein said plastic coating (9) has surface properties that repel mascara-carrying fluid.

5. The brush of claim 4, wherein said plastic coating (9) has hydrophobic surface properties.

6. The brush of claim 3, wherein said wire (3) is coated with said plastic coating (9) by extrusion.

7. The brush of claim 3 wherein the surface (10) of the plastic coating (9) is textured.

8. The brush of claim 1 wherein said bristles (4), after the twisting of the wire segments (1, 2) are cut, create an asymmetrical brush cross section.

9. The brush of claim 1, wherein said bristles comprise two plastic components, the softer component of which is located on the inside and is surrounded by the other, harder component in jacket-like fashion.

10. The brush of claim 1, wherein said bristles are embodied by fibers that have a plurality of hollow conduits extending longitudinally, which are separated from one another by ribs.

11. The brush of claim 10, wherein said bristles have an S configuration in cross section, the longitudinal conduits being formed by the inside of the S curves.

12. The brush, of claim 1, wherein said bristles are embodied as extending in zig-zagged, undulating or curved fashion longitudinally.

13. The brush, in particular of claim 1, wherein said wire segments are embodied as tubular wire segments having an internal hollow space.

14. A brush for applying mascara, said brush comprising, a plurality of bristles (4), each of said bristles having a round cross section that changes in diameter when moving along a longitudinal axis of said bristles, said plurality of bristles secured between twisted segments of wire, wherein said bristles extend out randomly from between said twisted segments of wire.

* * * * *